US006295855B1

(12) United States Patent
Gillbrand et al.

(10) Patent No.: US 6,295,855 B1
(45) **Date of Patent: *Oct. 2, 2001**

(54) METHOD AND MACHINE FOR MAKING A FINNED BODY

(75) Inventors: Per Gillbrand, Mariefred; Richard Öhman, Huddinge, both of (SE)

(73) Assignee: Interproperty N.V., St-Genesius-Rode (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,288

(22) PCT Filed: Nov. 12, 1997

(86) PCT No.: PCT/SE97/01898

§ 371 Date: Mar. 25, 1999

§ 102(e) Date: Mar. 25, 1999

(87) PCT Pub. No.: WO98/20990

PCT Pub. Date: May 22, 1998

(30) Foreign Application Priority Data

Nov. 12, 1996 (SE) ..... 9604122

(51) Int. Cl.[7] ..... B21H 1/00
(52) U.S. Cl. ..... 72/102

(58) Field of Search ..... 72/102, 103, 104, 72/105, 106, 107, 108, 109, 118

(56) References Cited

U.S. PATENT DOCUMENTS

| | | | | |
|---|---|---|---|---|
| 2,143,445 | * | 1/1939 | Le Jeune | 72/102 |
| 2,586,011 | * | 2/1952 | Doelter | 72/324 |
| 2,645,954 | * | 7/1953 | Pfingston | 72/118 |
| 4,170,124 | * | 10/1979 | MacGregor | 72/453.18 |
| 4,612,790 | * | 9/1986 | Przybyla et al. | 72/96 |

FOREIGN PATENT DOCUMENTS

| | | |
|---|---|---|
| 274921 | 4/1951 | (CH) . |
| 1 265 696 | 4/1968 | (DE) . |

* cited by examiner

*Primary Examiner*—Lowell A. Larson
(74) *Attorney, Agent, or Firm*—Browdy and Neimark

(57) ABSTRACT

A blank (12') of high-ductility material is formed with closely spaced thin fins (14) using a forming tool (18) which is rotatable about a tool axis (L) and comprises a set of flat circular space-apart forming discs (19) centered on the tool axis (L) and disposed side by side at fixed intervals along the tool axis (L) and in planes perpendicular thereto. The forming tool is displaced relative to the blank (12') at right angles to the tool axis (L) to cause the peripheral portions of the forming discs (19) during the cyclical movements of the forming tool (18) progressively to penetrate into the blank (12') and cause blank material to flow into the gaps separating the forming discs (19) and form planar fins (14).

17 Claims, 2 Drawing Sheets

M
D
22
$F_A$
18
L
21
17
C
24
$F_C$
12'
23
$F_B$

L
20
18
19
14
12'
13
C
N

METHOD AND MACHINE FOR MAKING A FINNED BODY

BACKGROUND OF THE INVENTION

1. Technical Field of the Invention

This invention relates to making a finned body of a high-ductility material.

More particularly, the invention relates to a method of making a finned body having a multiplicity of thin, closely spaced fins, such as a finned body having a fin density of at least one fin per millimeter, e.g. 1,5 or more fins per millimeter, and a fin height to thickness ratio of at least 5.

2. Prior Art

The invention also relates to a machine for making a finned body of this kind.

Such finned bodies find use in heat transfer structures, such as heat exchangers of the kind in which heat is transferred through the fins between a liquid or gaseous first fluid flowing in the passages defined and separated by the fins and a second fluid flowing through other passages in the finned body. The finned body often is generally cylindrical with the fins extending radially outwardly generally transversely to the axis of the body and may be made of aluminium or other light metal material of high heat conductivity.

In a known class of heat exchangers of this kind (see, for example, WO86/00395 or U.S. Pat. No. 4,923,003) the fins and the intervening gaps are dimensioned and designed such that the fluid flows in laminar fashion in the gaps or passages defined between the fins. In these heat exchangers the fins are very thin and very closely spaced: the fins may have a thickness of a few tenths of a millimeter, e.g. about 0.2 mm, and may be separated by a gap of approximately the same width, e.g. about 0.2 or 0.3 mm, and the height of the fins may be greater by one order of magnitude, e.g. about 3 mm.

As is readily appreciated, the forming of the fins on such heat exchanger bodies presents special problems, particularly where the finned body is made of a soft material, such as aluminium or some other light metal. For example, machining of such materials is often troublesome, because the material tends to stick to the machining tool and possesses poor chip breaking properties and because the surface finish tends to be poor. Moreover, because of the small fin thickness the fins easily deform or rupture under the influence of the forces to which they are subjected in the fin forming operation.

OBJECT AND SUMMARY OF THE INVENTION

A primary object of the invention is to provide a method and a machine for making a finned body of the kind indicated above.

In accordance with the invention, a method of making a finned body from a blank of a high-ductility material comprises the steps of providing a fin-forming tool having an axis of rotation and comprising a set of flat circular spaced-apart forming discs centered on and disposed side by side at fixed intervals along said axis of rotation and in planes perpendicular thereto, rotating the forming tool while causing it to perform cyclical movements over a surface of the blank with said planes maintained in a constant orientation and position relative to the blank, and relatively displacing the forming tool and the blank at right angles to the axis of rotation of the forming tool to cause the peripheral portions of the forming discs during said cyclical movements of the forming tool progressively to penetrate into the blank and cause blank material to flow into the gaps separating the forming disks and form planar fins.

In the case of a tubular blank the outer surface of which is a surface of revolution, the method preferably includes mounting the blank for rotation about an axis contained in a plane which also contains the axis of rotation of the forming tool. The cyclical movement of the forming tool then is a unidirectional rotational movement in which the forming discs progressively penetrate into the outer surface layer of the body and cause the material in that layer to flow outwardly in the gaps between adjacent forming discs.

Using the method according to the invention it is possible in an economical manner to make finned bodies in which the fin dimensions and the fin density are as indicated above.

Preferably, a lubricating fluid is supplied to the points or areas where the forming discs engage the blank.

In order that the working of the blank may be smooth even if the force acting between the blank and the forming tool vary during the cyclical relative movements, e.g. as a consequence of discontinuities in the blank surface being worked, it is preferred to provide for a positive control of the transverse displacement of the forming tool relative to the blank so that the rate of displacement is not affected by variations in the resistance to the penetration of the blank by the forming discs. Such positive control can be accomplished by using a hydraulic actuator device to displace the forming tool and controlling the displacement through controlled bleeding of hydraulic fluid from the actuator device.

According to the invention, a machine for making a finned body from a blank of a high-ductility material, comprises a blank holding device for supporting the blank, a forming tool which is mounted for rotation about a tool axis and displacement transversely to the tool axis and comprising a set of flat circular spaced-apart forming discs centered on and disposed side by side at fixed intervals along the tool axis and in planes perpendicular thereto, a motor for rotationally driving the forming tool, a displacement mechanism for relatively displacing the forming tool and the blank holding device transversely to the tool axis during rotation of the forming tool to cause the forming tool to move cyclically over a surface of the blank, and means for maintaining the forming discs in a constant orientation and axial position relative to the blank.

BRIEF DESCRIPTION OF THE DRAWINGS

The invention will be fully understood from the following detailed description with reference to the accompanying drawings.

DETAILED DESCRIPTION OF THE PREFERRED EMBODIMENT(S) OF THE INVENTION

Figure 1:
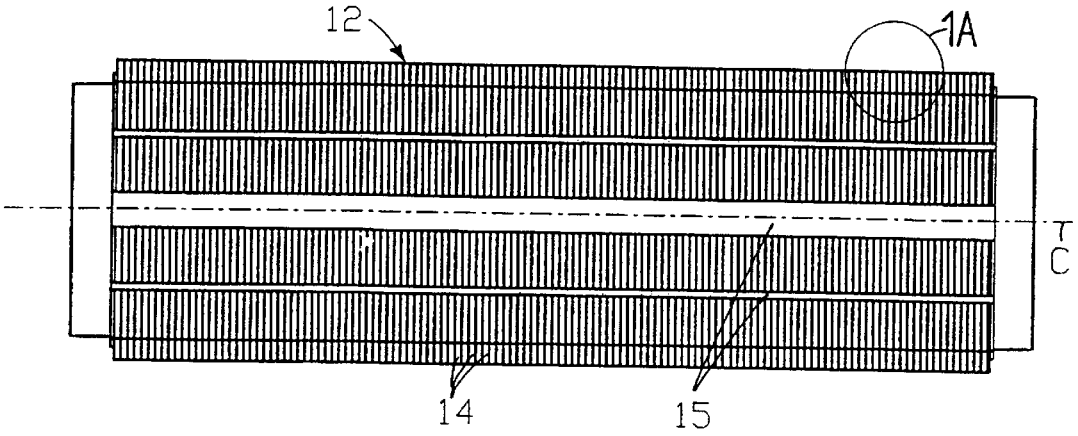
FIG. 1 is a side view of an exemplary finned body which can be made using the method and the machine according to the invention.
Figure 2:
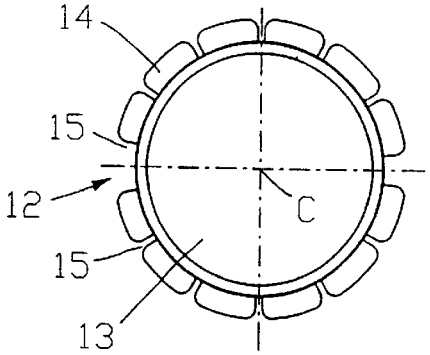
FIG. 2 is an end view of the finned body shown in FIG. 1.

The finned body shown in FIGS. 1 and 2 is a tubular, generally cylindrical heat exchanger body 12 of circular cross-section. In an actual exemplary embodiment, the body is made of substantially pure aluminium (e.g. of the grade carrying the U.S. standard designation AA 1050) but as will be appreciated it can also be made of other suitable high-ductility and thus easily deformable materials.

A central axial passage 13 defines a flow path extending through the heat exchanger body to pass a first fluid, such as cooling water. The outer circumferential surface of the heat exchanger body 12 is provided with a very large number of thin, closely spaced planar fins 14 disposed in parallel planes which are perpendicular to the axis C of the heat exchanger body.

In the illustrated exemplary embodiment the fins 14 are discontinuous. They accordingly do not extend continuously throughout the circumference of the heat exchanger body. Instead, as shown in FIG. 2, each of the said planes contains twelve fin sections separated circumferentially from one another by small gaps 15 forming twelve axially extending fluid passages. These gaps 15 and the axial passages they form have a technical function which is explained in WO86/00395. Two of the axial passages formed by the gaps 15 are wider than the other passages and also serve to form diametrically opposite distribution and collection passages for a second fluid, e.g. oil to be cooled.

In operation, the heat exchanger body 12 is enclosed in a housing (not shown) such that direct fluid communication between the central axial passage 13 and the space between the housing and the outer side of the heat exchanger body is prevented. Together with the housing the narrow gaps 16 between adjacent fins 14 define a flow path for the second fluid.

Figure 1A:
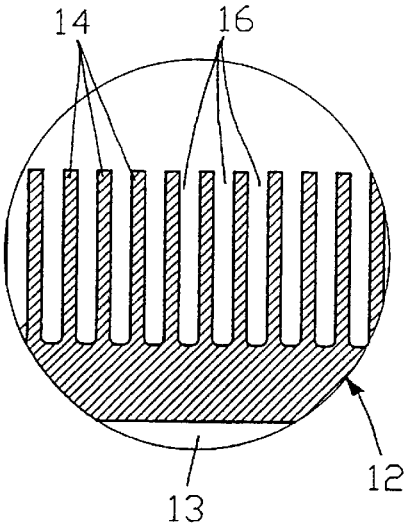
FIG. 1A is an enlarged representation of the area marked by a circle 1A in FIG. 1.
Figure 3:
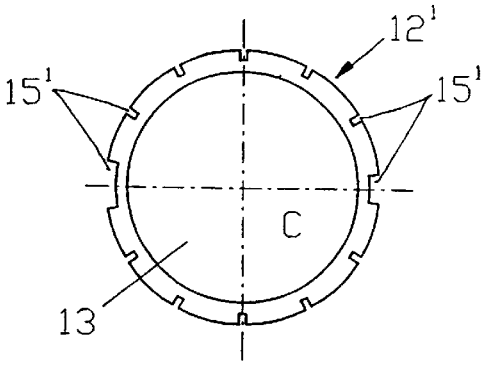
FIG. 3 is a cross-sectional view of a blank from which the finned body shown in FIGS. 1 and 2 is made.

In FIGS. 1A and 3 the size and spacing of the fins 14, notably the fin thickness and the width of the gaps 16 separating adjacent fins, are heavily exaggerated; in the aforesaid exemplary embodiment these dimensions actually are only a few tenths of a millimeter.

Figure 5:
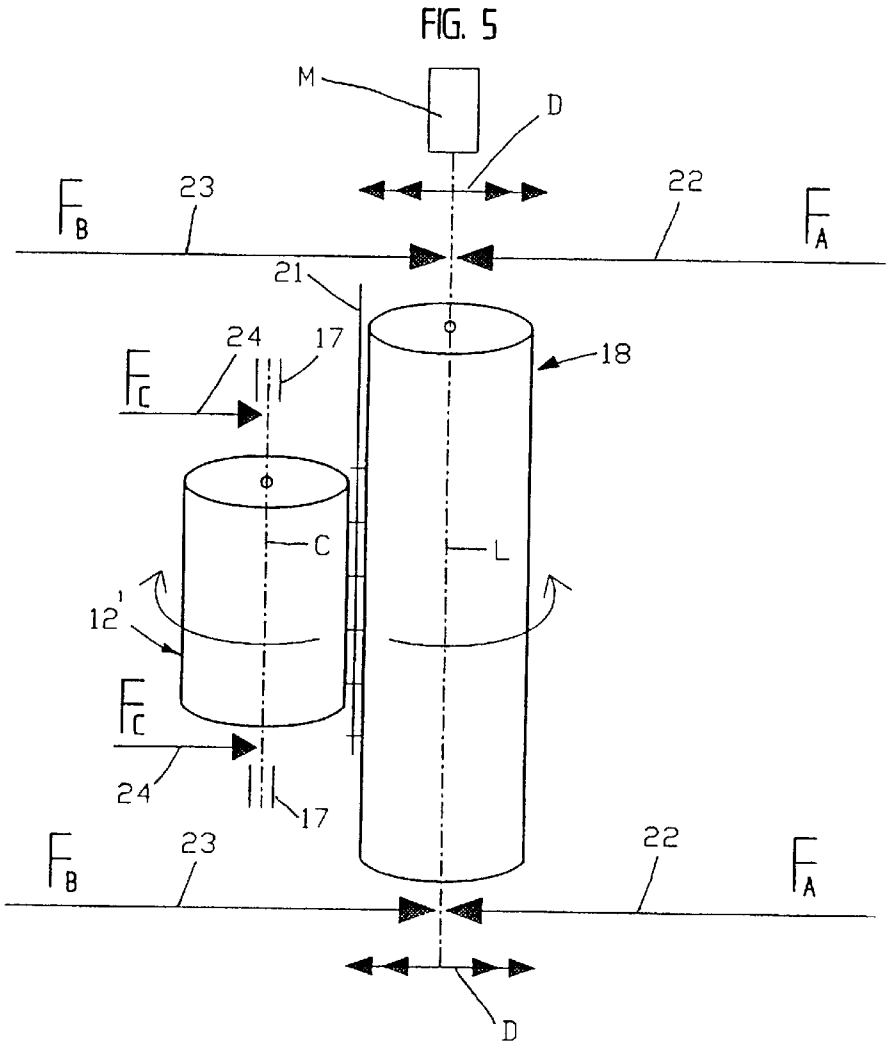
FIG. 5 is a diagrammatical view showing the transverse displacement of the forming tool.
Figure 4:
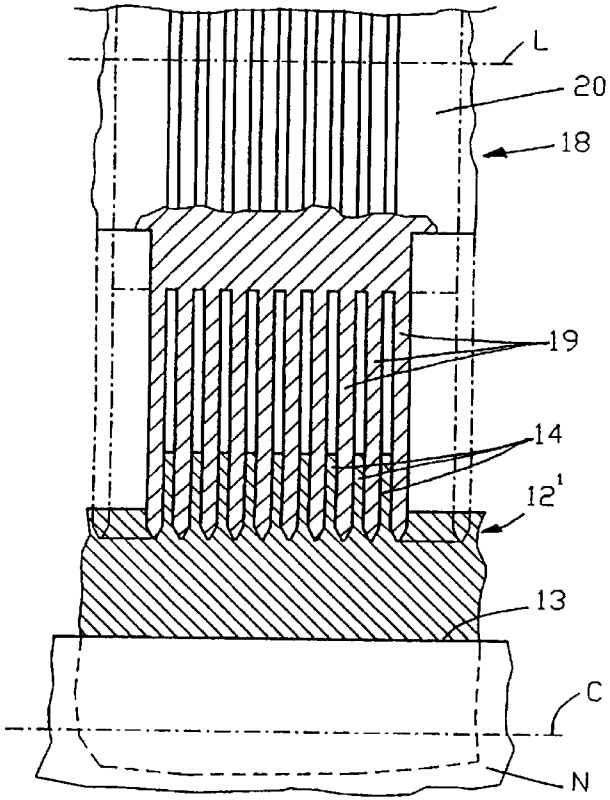
FIG. 4 is a diagrammatical view, partly in section, of the method and the machine used for making the finned body.

Referring to FIGS. 3 to 5, the fabrication of the heat exchanger body 12 shown in FIGS. 1 and 2 and the machine used therefor will now be described.

Fabrication starts from a blank 12' in the form of a length of an extruded rod having the cross-sectional shape shown in FIG. 3. The blank 12' exhibits the central axial passage 13; this passage remains more or less unaffected by the forming of the fins. Moreover, the blank 12' exhibits straight axial grooves 15' corresponding to the gaps 15 of the finished heat exchanger body. The outer diameter of the blank is slightly smaller than the outer diameter of the finished heat exchanger body as measured across the fins 14 thereof.

The blank 12' is first journalled to rotate, preferably freely, about its axis C in a blank holding device diagrammatically indicated at 17 in FIG. 5. The structure for journalling the blank is constructed such that it is capable of absorbing the forces acting transversely on the blank without allowing transverse displacement of the axis C of the blank, i.e. the axis of rotation of the blank. Suitably, the blank is mounted on a mandrel N (indicated in FIG. 4) which is rotatable about a stationary axis, not shown, and fits snugly in the central axial passage 13 of the blank.

The fins 14 are formed in a machine which comprises a generally cylindrical forming tool, designated by 18 in FIGS. 4 and 5. This tool is arranged to be rotated unidirectionally by a motor M about a tool axis L which is parallel to the axis C of the blank mounted on the mandrel N. By means of a device which is not shown in detail, the forming tool 18 can be displaced transversely toward and away from the blank 12' while maintaining the parallel disposition of the axes C and L and without changing its axial position relative to the blank. In FIG. 5 this transverse displacement of the forming tool 18 is indicated by pairs of double arrows D pointing away from the tool axis L.

The forming tool 18 comprises a shaft 20 and a set of flat circular forming discs 19 centered on the tool axis L and disposed in planes which are perpendicular to the tool axis. The forming discs 19 are spaced apart axially by fixed distances such that adjacent discs define between them a gap the width of which corresponds to the thickness of the fins to be formed on the blank 12'. All forming discs 19 are of the same diameter and their thickness corresponds to the width of the gaps 16 between adjacent fins 14 on the finished heat exchanger body 12. Their peripheral edges are rounded or slightly chamfered.

The number of forming discs 19 of the set is related to the number of fins 14 to be formed simultaneously on the blank 12' such that the number of gaps defined by adjacent forming discs corresponds to the number of fins to be formed.

After the blank 12' has been mounted in the machine as described above, the forming tool 18 is rotated and displaced toward the blank so that all forming discs 19 will engage the circumferential surface of the blank 12' simultaneously. The friction occurring upon engagement of the peripheral edge of the forming discs 19 with the circumferential surface of the blank 12' will cause the blank to rotate. As the continued slow displacement of the forming tool 18 progresses continuously toward the axis C of the blank, the peripheral portion of each forming disc 19 will penetrate into the circumferential surface region of the blank 12' and force the blank material in that region to flow first laterally a small distance and then radially outwardly in the gaps between the adjacent forming discs as shown in FIG. 4.

As the penetration of the blank 12' by the forming discs 19 progresses during the unidirectional continuous rotation of the forming tool and the blank, each forming disc 19 forming its own groove in the blank, the height of the fins 14 increases. Since in the illustrated example the width of the gaps between adjacent forming discs 19 is smaller than the forming disc thickness, the height of the fins 14 will increase more rapidly than the penetration depth. With the exemplary dimensions of the gap width and the disc thickness given above, the height of the fins 14 will be approximately 2.5 times the depth of penetration, that is, the distance through which the forming tool 18 is displaced toward the axis C while in engagement with the blank.

When the blank 12' and the forming tool 18 are in engagement with one another and rotate, a lubricating fluid should be supplied to the areas of engagement of the forming discs 19 to reduce the friction, thereby to reduce the danger of tearing the fins being formed. Means for supplying the lubricating fluid is indicated at 21 in FIG. 5.

The speed at which the forming tool 18 is displaced when in engagement with the blank 12' must be adapted to the material of the blank, the thickness of the fins 14 to be formed and that of the forming discs 19 and also to the peripheral speeds of the forming tool and the blank. A certain trial and error adjustment of the speed of displacement may be required. Generally, however, the displacement must be slow; a displacement speed of 0.5 to 1 mm/minute has been found to be suitable for materials like pure aluminium at peripheral speeds of 100 to 300 m/minute.

Whenever the forming tool 18 is in engagement with the blank 12', the transverse displacement of the tool should be effected smoothly so that sudden variations of the force with which the forming discs 19 press against the blank will be minimized. Using a blank of the design illustrated and described above, the discontinuities formed by the axial grooves 15' make a complete elimination of such variations very difficult or impossible.

However, in accordance with a preferred feature of the invention the variations can be kept within acceptable limits by positively controlling the speed of displacement such that it will not be affected by any occurring variations in the aforementioned force.

Such positive control can suitably be effected in the manner diagrammatically illustrated in FIG. 5.

In FIG. 5 a pair of hydraulic cylinders of a first hydraulic actuator are represented by two parallel arrows 22 and act in the direction of the blank axis C in the plane containing that axis and the tool axis L. The first hydraulic actuator operates to apply a force $F_A$ tending to displace the forming tool 18 toward the stationary blank axis C while maintaining the parallel orientation of the tool axis L relative to the blank axis.

This displacement is counteracted by a second hydraulic actuator which is similarly represented by two parallel arrows 23 which are aligned with the arrows 22 but directed oppositely. Naturally, the parallel displacement of the forming tool is also opposed by the force, represented by arrows $F_C$, which acts between the blank 12' and the forming discs 19 of the forming tool in the plane containing the axes C and L. When the opposing forces are balanced, $F_A$ is equal to the sum of $F_B$ and $F_C$.

The speed at which the first hydraulic actuator can displace the forming tool 18 toward the axis C of the blank 12' is determined by the rate at which hydraulic liquid is allowed to bleed from a cylinder compartment of the second actuator. This rate in turn is determined by a restrictor device (not shown) of constant-flow type, that is a restrictor device which passes a hydraulic fluid flow the volumetric flow rate of which is always substantially constant and thus substantially independent of the pressure drop across it.

Accordingly, the speed of displacement of the forming tool 18 is substantially independent of any variations of the force $F_A$.

Preferably, the arrangement is such that the force $F_A$ is many times, e.g. 10 to 15 times, the force $F_C$ so that the difference between the forces $F_A$ and $F_B$ is only a small fraction of each of these forces.

What is claimed is:

1. A method of making a finned body (12) from a blank (12') of a high-ductility and easily deformable aluminum material, comprising providing a blank (12') of said high-ductility and easily deformable aluminum material in working relationship to a fin-forming tool (18) having an axis of rotation (L) and comprising a set of flat circular spaced-apart forming discs (19) centered on and disposed side-by-side at fixed intervals along said axis of rotation (L) and in planes perpendicular thereto, rotating the forming tool (18) at a speed of 100–300 m per minute while causing it to perform cyclical movements over a surface of the blank (12') with said planes maintained in a constant orientation and position relative to the high-ductility aluminum blank, and relatively displacing the forming tool (18) and the blank (12') at a rate of 0.5 to 1 mm per minute at right angles to the axis (L) of rotation of the forming tool (18) to cause the peripheral portions of the forming disks (19) during said cyclical movements of the forming tool (18) progressively to slowly penetrate into the blank (12') and cause said easily deformable and high-ductility aluminum blank material to deform and flow into gaps separating the forming disks (19), and thereby forming said finned body (12), from the high-ductility aluminum blank, having at least one fin per millimeter along a longitudinal axis of the body, wherein each fin has a height at least five times a width of the fin.

2. A method as claimed in claim 1 in which the blank (12') is tubular, including the step of mounting the blank for rotation about an axis (c) which is contained in a plane which also contains the axis (L) of rotation of the forming tool (18), said surface of the blank being a surface of revolution wherein the axis (C) of rotation of the blank is parallel to the axis (L) of rotation of the forming tool.

3. A method as claimed in claim 2 in which the blank (12') is tubular and mounted on a mandrel (N) with substantially zero play between the blank and the mandrel.

4. A method as claimed in claim 2 in which said surface of the blank (12') is generally cylindrical.

5. A method as claimed in claim 2 in which the forming tool (18) is rotated unidirectionally.

6. A method as claimed in claim 2 in which the blank (12') is rotated by frictional engagement with the forming tool (18).

7. The method of claim 6 further comprising supplying a lubricating fluid to locations where the forming discs engage the blank.

8. A method as claimed in claim 1 including the step of supplying a lubricating fluid to the sites of contact between the forming discs (19) and the blank (12').

9. A method as claimed in claim 1 in which the relative displacement of the forming tool (18) and the blank (12') is effected by means of a first hydraulic actuator (22) applying to the forming tool a first force ($F_A$) directed toward the blank (12') and a second hydraulic actuator (23) applying to the forming tool (18) an oppositely directed second force ($F_B$) which is smaller than the first force ($F_A$), whereby the forming tool (18) applies a differential force ($F_C$) to the blank (12').

10. A method as claimed in claim 9 which the magnitude of the oppositely directed force ($F_B$) is controlled by controlled bleeding of hydraulic fluid from the second actuator (23), wherein the first force ($F_A$) is several times the differential force ($F_C$).

11. The method of claim 10 wherein said first force ($F_A$) is at least 10 times said differential force ($F_C$).

12. A method as claimed in any one of claim 1 in which the blank (12') is essentially pure aluminum.

13. A machine for making a finned body (12) from a blank (12') of a high-ductility material, comprising a blank holding device (17) for supporting the blank (12'), a forming tool (18) which is mounted for rotation about a tool axis (L) and displacement transversely to the tool axis (L) and comprising a set of flat circular spaced-apart forming discs (19) centered on and disposed side by side at fixed intervals along the tool axis (L) and in planes perpendicular thereto, a motor for rotationally driving the forming tool (18), a displacement mechanism (22, 23) for relatively displacing the forming tool (18) and the blank holding device (17) transversely to the tool axis (L) during rotation of the forming tool to cause the forming tool to move cyclically over a surface of the blank (12'), and means for maintaining the forming discs (19) in a constant orientation and axial position relative to the blank (12'), wherein the displacement mechanism comprises a first hydraulic actuator (22) connected to the forming tool (18) to apply to it a displacement force ($F_A$) directed toward a blank held by the blank holding device (17) and a second hydraulic actuator (23) connected to the forming tool (18) to apply to it an oppositely directed force ($F_B$) which is smaller than the displacement force ($F_A$), wherein the second actuator (23) is adapted to apply the oppositely directed force ($F_B$) with a magnitude thereof added to a differential force ($F_C$) acting on the blank wherein the sum of force ($F_B$) and ($F_C$) is of the same order of magnitude as the displacement force ($F_A$), and wherein said force ($F_A$) is many times said force ($F_C$).

14. A machine as claimed in claim 13 in which the blank holding device (17) includes a rotatable mandrel (N) for supporting the blank for rotation about a blank axis (C) of rotation.

15. A machine as claimed in claim 13 including means (21) for supplying a lubricating fluid to the forming discs (19).

16. A machine as claimed in claim 13 including means for controlled bleeding of hydraulic fluid from the second hydraulic actuator (23).

17. The machine of claim 13 wherein, in said displace mechanism, said force ($F_A$) is 10–15 times said force ($F_C$).

* * * * *